United States Patent [19]

Harpenslager et al.

[11] 3,954,386

[45] May 4, 1976

[54] FLARE BURNER FOR BURNING OFF COMBUSTIBLE WASTE GASES

[75] Inventors: Christiaan Harpenslager, Voorburg, Netherlands; Ulrich Ruhfus, Metzkausen-Hassel, Germany

[73] Assignees: Gesellschaft Fur Huttenwerksanlagen mbH, Dusselforf, Germany; Smitsvonk B.V., Voorburg, Netherlands

[22] Filed: Apr. 24, 1974

[21] Appl. No.: 463,769

[30] Foreign Application Priority Data

May 18, 1973 Germany ..... 2325225

[52] U.S. Cl. ..... 431/285; 431/202; 431/353; 431/354; 23/277 C

[51] Int. Cl.[2] ..... F23G 9/00

[58] Field of Search ..... 431/202, 285, 354, 353; 23/277 C

[56] References Cited

UNITED STATES PATENTS

| | | | |
|---|---|---|---|
| 1,260,442 | 3/1918 | Pickup | 431/354 |
| 2,879,862 | 3/1959 | Burden, Jr. | 23/277 C |
| 3,414,362 | 12/1968 | Schoppe | 431/353 |
| 3,607,119 | 9/1971 | Nesbitt | 431/202 |
| 3,676,048 | 7/1972 | Sellors, Jr. et al. | 432/285 |

*Primary Examiner*—Kenneth W. Sprague
*Assistant Examiner*—James C. Yeung
*Attorney, Agent, or Firm*—Toren, McGeady and Stanger

[57] ABSTRACT

A flare burner for flaring or burning off combustible waste gases comprises a venturi burner tube, a waste gas supply pipe having a gas outlet opening at the throat of the venturi burner tube and forming an injector for drawing air through an intake into the venturi burner tube, and pilot burner jets for burning combustion maintenance gas projecting laterally through the wall of the venturi burner tube downstream of its throat. The dimensions of the burner are such that the ratios $d' : d$, D, $h$ and $a$ are in the ranges 1 : from 1.2 to 3 : from 2 to 6 : from 4 to 20 : from 3 to 15; where $d'$ is the diameter of the gas outlet opening, $d$ is the throat diameter of the venturi burner tube, D is the maximum diameter of the venturi burner tube downstream of its throat, $h$ is the length of the venturi burner tube from its throat to its point of maximum diameter downstream of its throat, and $a$ is the length of the venturi burner tube from its throat to the entry points of the pilot jets.

5 Claims, 3 Drawing Figures

FLARE BURNER FOR BURNING OFF COMBUSTIBLE WASTE GASES

This invention relates to flare burners for flaring or burning off combustible waste gases, for example waste gases from cupola furnaces, the burners being of the kind comprising a venturi burner tube, a waste gas supply pipe having a gas outlet opening at the throat of the venturi burner tube and forming an injector for drawing air through an intake into the venturi burner tube, and pilot burner jets for burning combustion maintenance gas projecting laterally through the wall of the venturi burner tube downstream of its throat.

It is conventional to flare combustible waste gases to prevent or reduce environmental pollution and this is done with the waste gases from cupola furnaces amongst other sources. In existing burners for this purpose, combustion air is drawn in from below the burner through an inlet at the bottom of the burner tube. Gas which is more readily combustible than the waste gas is supplied to the pilot jets for the purpose of igniting and supporting the combustion of the waste gas.

In conventional burners of this kind the pilot burner jets usually issue into the burner tube in the vicinity of the outlet of the waste gas supply pipe. It has been found that when these conventional burners are used for flaring combustible waste gases, it is not possible to achieve the desired optimum combustion of the gases and thus full reliability. In particular, there is a lack of a proper adjustment to the composition of the gases at any moment so that no combustion, or insufficient combustion, takes place especially when the waste gases are weak in combustible components. There is also a risk of the flame going out when, for example, a strong wind impinges upon the burner. Moreover, it is only possible to extinguish the flame, or prevent blowback in case of emergency, by the provision of a trap, such as a molecular trap, or by supplying inert gases to the burner. This involves considerable expense. Another considerable disadvantage is that, with conventional burners, the proportion of combustion maintenance gas introduced through the pilot burners for the combustion of weak waste gases is much too high, thus detracting from the economics of the flaring process.

The object of the present invention is to overcome the disadvantages described above of existing burners of the kind described and provide a burner which enables satisfactory and stable combustion of waste gases to take place with a reduced input of energy and which, in an emergency, also permits rapid extinguishing of the flame.

The invention is based on the discovery that the ratios between various dimensions of the burner including the position of the pilot burners relative to the throat of the venturi burner tube is of decisive importance for the proper functioning of the burner, especially when weak gases are being burned.

According to this invention, the dimensions of a flare burner of the kind described are such that the ratios $d' : d$, D, $h$ and $a$ are in the ranges 1: from 1.2 to 3: from 2 to 6: from 4 to 20: from 3 to 15, where $d'$ is the diameter of the gas outlet opening, $d$ is the throat diameter of the venturi burner tube, D is the maximum diameter of the venturi burner pipe downstream of its throat, $h$ is the length of the venturi burner tube from its throat to its point of maximum diameter downstream of its throat, and $a$ is the length of the venturi burner tube from its throat to the entry points of the pilot jets.

A burner which has these dimensional relationships leads to very satisfactory combustion, even in the case of very weak waste gases, for which the flame propagation velocity in the burner must be kept low. By the ratios between the throat and maximum diameters and between the throat diameter and the length of the burner tube, it can be ensured that the flame does not emerge from the end of the burner tube into the atmosphere, and therefore cannot be blown out by the wind. It is moreover of particular importance that the length between the throat and the points of entry of the pilot jets into the burner tube is so selected that the pilot jets lie in the region of the theoretical flame propagation velocity of the waste gas. This results in the proportion of combustion maintenance gas in the flare being kept extremely low, so that economic combustion can be achieved. Experiments have shown that the burner operates satisfactorily between widely ranging limits.

It has proved especially advantageous if the burner is operated in such a way that $d'$ is equal to from 0.2 to $0.4 \sqrt{V}$ meters, where V is the flow rate of the waste gas to be burned in cubic meters per second. Excellent combustion is moreover obtained, if the air intake is adjustable to vary its area. The resulting facility for exactly proportioning the combustion air is of particular advantage when the waste gas is weak, since combustion can be very adversely affected by either a too-large or a too-small air flow rate. By using an adjustable air intake it is moreover also possible, in emergency, to extinguish the burner rapidly by opening the air intake fully with the pilot jets shut off, thus causing the maximum possible flow of air to pass through the burner. This quantity of air is sufficient for immediately extinguishing the flame. For the purpose of regulating the air intake, the burner preferably has a fixed perforated disc and a rotatable perforated disc extending across an annular gap between the gas supply pipe and the venturi burner tube upstream of the throat, rotation of the rotatable disc varying the extent of registration of the perforations in the discs. The discs may be annular and extend around the gas supply pipe, the inner periphery of the fixed disc being fixed to the pipe. This enables the desired rate of air flow to be finely metered into the burner tube.

An example of a flare burner in accordance with the invention is illustrated in the accompanying drawings, in which.

Figure 3:
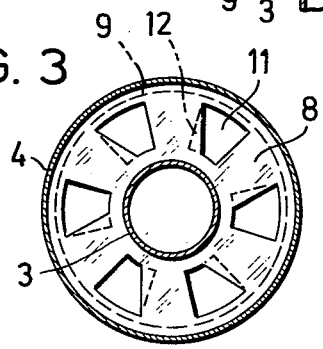
Figure 2:
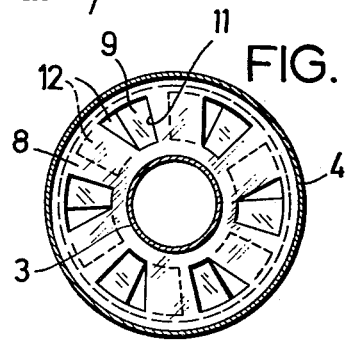
FIG. 2 is a section as seen in the direction of the arrows on the line II—II of FIG. 1; and, FIG. 3 is a section similar to FIG. 2, but showing the burner differently adjusted.

The burner comprises a venturi burner tube 1, into which pilot burner jets 2 project laterally. A combustible gas supply pipe 3 is disposed at the bottom of the tube 1 and forms an injector projecting into a venturi air inlet 4 below the tube 1. The supply pipe 3 has a gas outlet opening 5. Between the pipe 3 and the venturi inlet 4 is an annular gap 6, through which the combustion air necessary for the combustion of the waste gases is drawn into the tube 1. To regulate the rate of air supply, a regulating device 7 is mounted at the lower end of the inlet 4 and this device comprises a fixed perforated annular disc 8 and a rotatable perforated annular disc 9. As can be seen from FIGS. 2 and 3, both the discs 8 and 9 have openings 11 and 12 which are substantially trapezium shaped. The rotation of the perforated disc 9 is limited by abutments, not shown. A pneumatic ram may be used, for example, for rotating it. In FIG. 2, the two discs 8 and 9 are shown with their openings 11 and 12 largely offset from one another, so that between them they provide only comparatively small wedge-shaped openings for the air to be drawn in. In FIG. 3 however, the openings 11 and 12 are largely in register with each other so that larger free openings for the passage of the air are provided.

Figure 1:
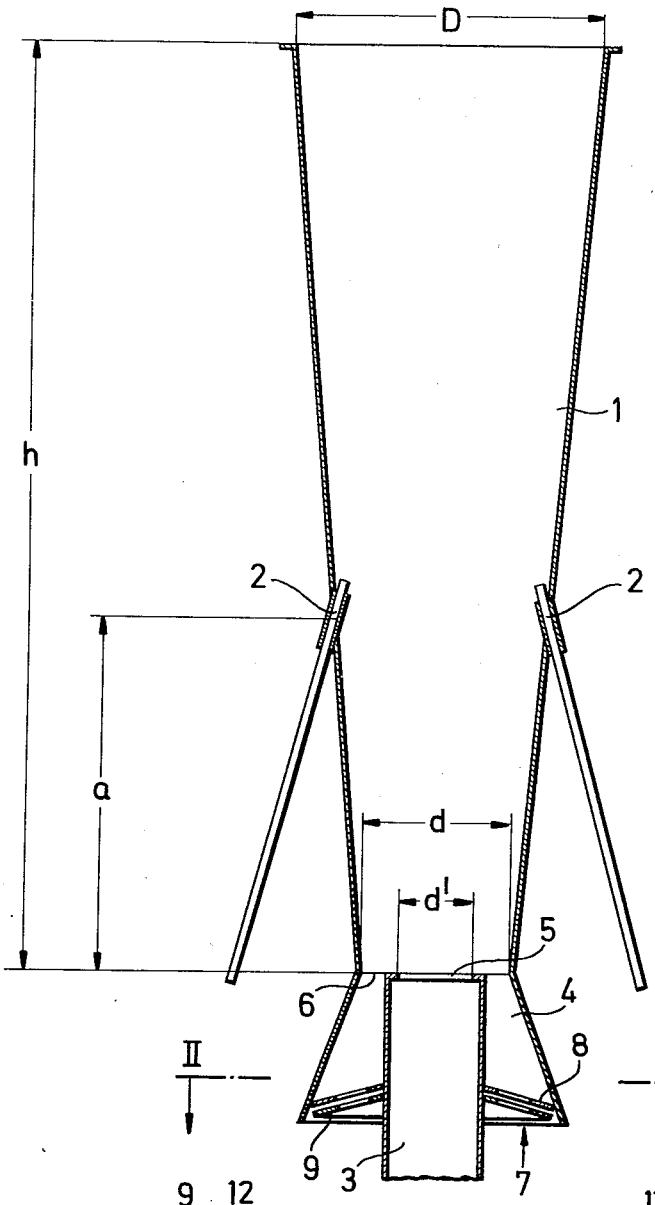
FIG. 1 is a vertical axial section through the burner.

As can be seen from FIG. 1, the diameter of the outlet opening 5 of the pipe 3 is designated as $d'$, the throat diameter of the venturi burner tube 1 as $d$, the maximum diameter of the tube 1 downstream of its throat as D, and the length of the tube 1 from its throat to its point of maximum diameter as $h$, and the length between the throat and the entry points of the pilot jets as $a$.

To achieve optimum combustion with minimum energy consumption, the dimensions of the flare burner and the arrangement of the pilot burner jets are such that the ratios $d' : d$, D, $h$ and $a$ are within the ranges 1:1.2 to 3, 2 to 6, 4 to 20 and 3 to 15. Here, the diameter $d'$ of the waste gas opening 5 is from 0.2 to 0.4 $\sqrt{V}$ meters, where V is the flow rate of gas to be burned in $m^3$/second. The pilot burners 2 are in a region where rapid ignition takes place.

By adjusting the regulating device 7, a greater or lesser flow of air can be provided, according to demand and according to the nature of the waste gas to be burned. The regulating device 7 is set as shown in FIG. 2, when combustion is to be started. The two discs 8 and 9 are brought into the setting shown in FIG. 3, when the flame of the burner is to be extinguished and this is then achieved by drawing in a large excess of air.

Experiments have shown that a flow at a rate of approximately 40 $Nm^3$/hour of natural gas is necessary for the initial ignition of a flow at the rate of 22,000 $Nm^3$/hour of waste gas. After combustion had been started a flow of only from 10 to 20 $Nm^3$/hour of natural gas was required to maintain the combustion. In these experiments, a flare burner 1 having four pilot burner jets 2 and having the following dimensions was used: $d' = 840$ mm; $d = 1500$ mm; $D = 3000$ mm; $h = 8000$ mm; and $a = 3000$ mm.

The temperatures measured at the outer face of the tube 1 permit normal steel to be used. If required a protective coating of high temperature-resistant paint can be applied to the outside of the tube 1.

We claim:

1. In a flare burner for burning combustible waste gases comprising a venturi burner tube including means defining a throat in said venturi tube, a waste gas supply pipe including means defining a gas outlet opening at one end of said pipe, means mounting said gas supply pipe coaxially with said venturi tube with said gas outlet opening located at said venturi throat, said pipe and said venturi tube being sized to define an annular opening between said venturi throat and said gas outlet opening, means defining an air intake into said venturi tube for introducing air through said annular opening, and pilot burner jets projecting laterally into said venturi tube downstream of said throat for burning combustion maintenance gas, the improvement wherein the diameter of said gas outlet opening is $d'$, the diameter of said venturi throat is $d$, the maximum diameter of said venturi tube downstream of said throat is D, the length of said venturi tube from said throat to the point of said maximum diameter is $h$, and the distance from said throat to the points of entry of said pilot jets into said venturi tube is $a$, and wherein the ratios of said dimensions $d' : d$, D, $h$ and $a$ is within the range 1: from 1.2 to 3, from 2 to 6, from 4 to 20 and from 3 to 15 respectively.

2. A burner according to claim 1 comprising air intake adjustment means located around said gas pipe upstream from said gas outlet opening for varying the area through which air is introduced into said venturi tube.

3. A burner according to claim 2 wherein said air intake adjustment means comprise a fixed perforated disc, a rotatable perforated disc, means mounting said discs to extend between said gas supply pipe and said venturi upstream of said throat, and means for rotating said rotatable disc to vary the extent of registration of said perforations thereof with said perforations in said fixed disc.

4. A burner according to claim 3 wherein said venturi burner tube comprises a frustoconical section diverging upstream of said throat around said gas supply pipe and wherein said perforated discs both comprise a frustoconical configuration diverging in the same direction as said upstream frustoconical section of said venturi burner tube, said perforations in said perforated discs being of a trapezoidal shape.

5. A burner according to claim 1 including means for supplying waste gas to said gas opening at a velocity of V cubic meters per second, wherein $d'$ is equal to from about 0.2 to 0.4 $\sqrt{V}$ meters.

* * * * *